United States Patent [19]

Ercole

[11] Patent Number: 4,903,594

[45] Date of Patent: Feb. 27, 1990

[54] DRIVE ARRANGEMENT FOR KNIVES IN SILK-SCREEN PRINTING MACHINES

[75] Inventor: Pellegrina Ercole, Rozzano, Italy

[73] Assignee: C.M.S. S.r.l., Zibido San Giacomo, Italy

[21] Appl. No.: 165,088

[22] Filed: Mar. 7, 1988

[30] Foreign Application Priority Data

May 27, 1987 [IT] Italy ..... 21691/87[U]

[51] Int. Cl.[4] ..... B41F 15/42

[52] U.S. Cl. ..... 101/123

[58] Field of Search ..... 101/123, 124

[56] References Cited

U.S. PATENT DOCUMENTS

| | | | |
|---|---|---|---|
| 3,143,961 | 8/1964 | Jaffa et al. | 101/123 |
| 3,731,623 | 5/1973 | Bubley et al. | 101/123 X |
| 3,859,917 | 1/1975 | Bubley et al. | 101/123 |
| 3,885,493 | 5/1975 | Jaffa | 101/123 |
| 4,080,893 | 3/1978 | Wedell | 101/123 X |
| 4,111,118 | 9/1978 | Green et al. | 101/123 |
| 4,276,826 | 7/1981 | Bubley et al. | 101/123 |
| 4,586,433 | 5/1986 | Jaffa et al. | 101/123 |

FOREIGN PATENT DOCUMENTS 3220489 12/1983 Fed. Rep. of Germany ..... 101/123

*Primary Examiner*—Clifford D. Crowder

*Attorney, Agent, or Firm*—Browdy & Neimark

[57] ABSTRACT

A knife drive for spreading and thrusting ink through printing matrices of silk-screen printing machines includes first drive members adapted to impart on knives parallel reciprocating movements to a related matrix and comprising at least one plate element reciprocable parallel to the matrix itself, a through-going slot formed in the plate element and parallel to the matrix, and a pin through-penetrating slidingly and rotatably the through-going slot and engaging the knives, and second drive members adapted to impart on the knives up and down movements with respect to the matrix and comprising a guide rigid with the plate element, extending in a transverse plane to the pin and along a transverse direction to the through-going slot, and a small lever attached transversely to the pin and engaging slidingly with the guide.

6 Claims, 4 Drawing Sheets

DRIVE ARRANGEMENT FOR KNIVES IN SILK-SCREEN PRINTING MACHINES

BACKGROUND OF THE INVENTION

1. Field of the Invention

This invention relates to a drive arrangement for knives employed to spread and thrust ink through printing matrices on silk-screen printing machines.

2. The Prior Art

As is known, the silk-screen printing process involves the use of a matrix or stencil formed of a grid-like fabric, or its equivalent, stretched over a supporting frame. The matrix proper is prepared by blocking meshes of the fabric grid where colorless areas locate, using a variety of techniques which provide, for instance, for the use of special gelatine papers cut to a desired pattern and subsequently hot pressed against the grid-like fabric. The gelatine then melts and blocks the meshes.

Printing is carried out by placing the matrix over a surface to be imprinted which may comprise any of a number of materials, such as cloth, glass, plastics, metal, etc., and pouring ink over it. The ink is then spread and forced through by means of specially provided knives in order to make it to penetrate the open meshes of the grid-like fabric uniformly.

Such known arrangements are generally operated by compressed air, which also provides the motive power for the linkages comprising them. The demand for compressed air may be quite high, especially where plural silk-screen printing stations are provided, as is usually the case with many of the industries employing this printing technique, and it is a well-recognized fact that the components of a compressed air system are fairly critical and require periodic checking and reconditioning of worn parts.

It has also been found that known arrangements cannot always provide for a truly uniform distribution of the ink across the matrix because of their being inadequate to set the knives at suitable inclination angles as the distance of the knives from the matrix changes.

It has been found, moreover, that such known arrangements occasionally fail to permit of a sufficiently accurate adjustment of the distance of the knives from the matrix.

SUMMARY OF THE INVENTION

In view of the above-outlined situation, the technical aim of this invention is to provide a drive arrangement for the ink spreading and thrusting knives which can substantially obviate the cited shortcomings.

Within this technical aim, an important object of this invention is to provide a drive arrangement whose operation involves the use of simple and reliable means of a mechanical nature and which affords long maintenance-free life features.

Another important object of the invention is to provide a drive arrangement which affords proper and accurate positioning of the ink spreading and thrusting members relatively to the printing matrix.

The above-noted technical aim is substantially achieved by a drive arrangement for knives employed to spread and thrust ink through printing matrices on silk-screen printing machines, comprising first drive members operative to impart to said knives reciprocating movements across a matrix and second drive members operative to impart to said knives up and down movements relatively to said matrix, and being characterized in that said first drive members include at least one plate element reciprocable along a parallel direction to said matrix, a through-going slot formed in said plate element and lying substantially parallel to said matrix, and a pin passed slidingly and rotatably through said through-going slot and engaging with said knives, and in that said second drive members include a guide made rigid with said plate element and extending in a transverse plane to said pin along an at least mainly transverse direction to said through-going slot, and a small lever attached transversely to said pin and engaged slidingly in said guide.

BRIEF DESCRIPTION OF THE DRAWINGS

Further features and the advantages will become apparent from the detailed description of a drive arrangement according to the invention as shown by way of example in the accompanying drawings, where.

DETAILED DESCRIPTION OF THE INVENTION

Figure 1:
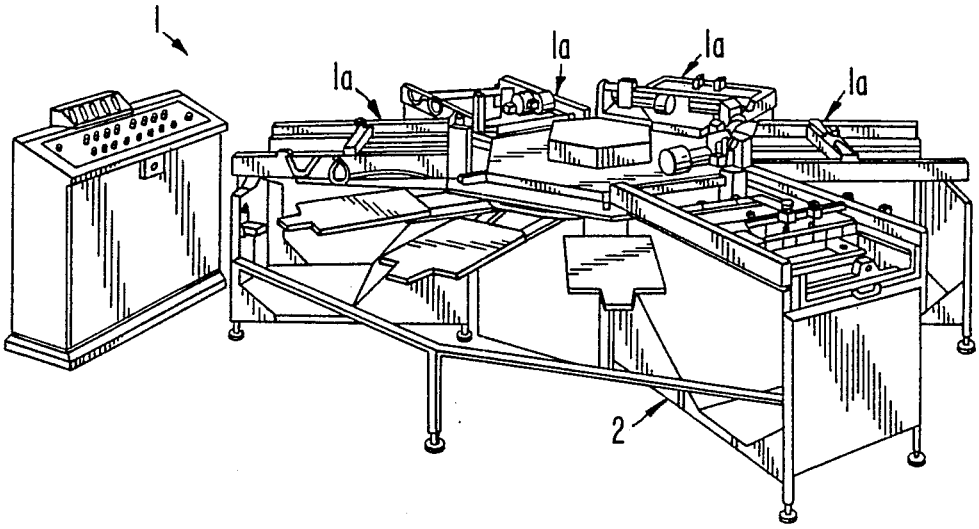
FIG. 1 is a perspective view showing a set of silk-screen printing stations as used, for example, to print in succession different color patterns on one material.
Figure 6:
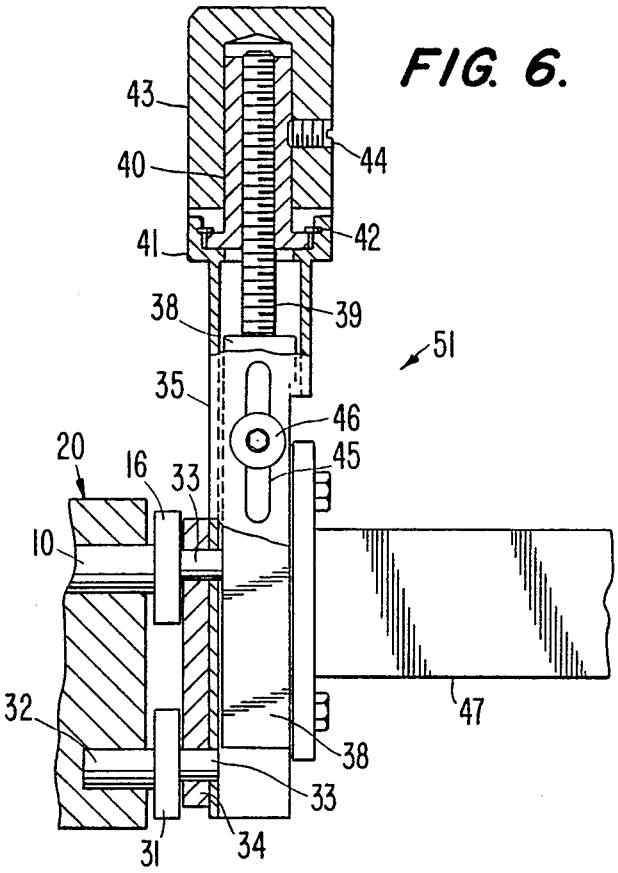
FIG. 6 is a part-sectional side view of a mechanical device for controlling the vertical positions of the knives relatively to the matrix.

With reference to the drawing views, the invention provides a silk-screen printing station which, in the specific instance illustrated therein, is incorporated to a machine 1 having plural printing stations 1*a* laid serially into a circumferential arrangement as shown in FIG. 1.

Figure 2:
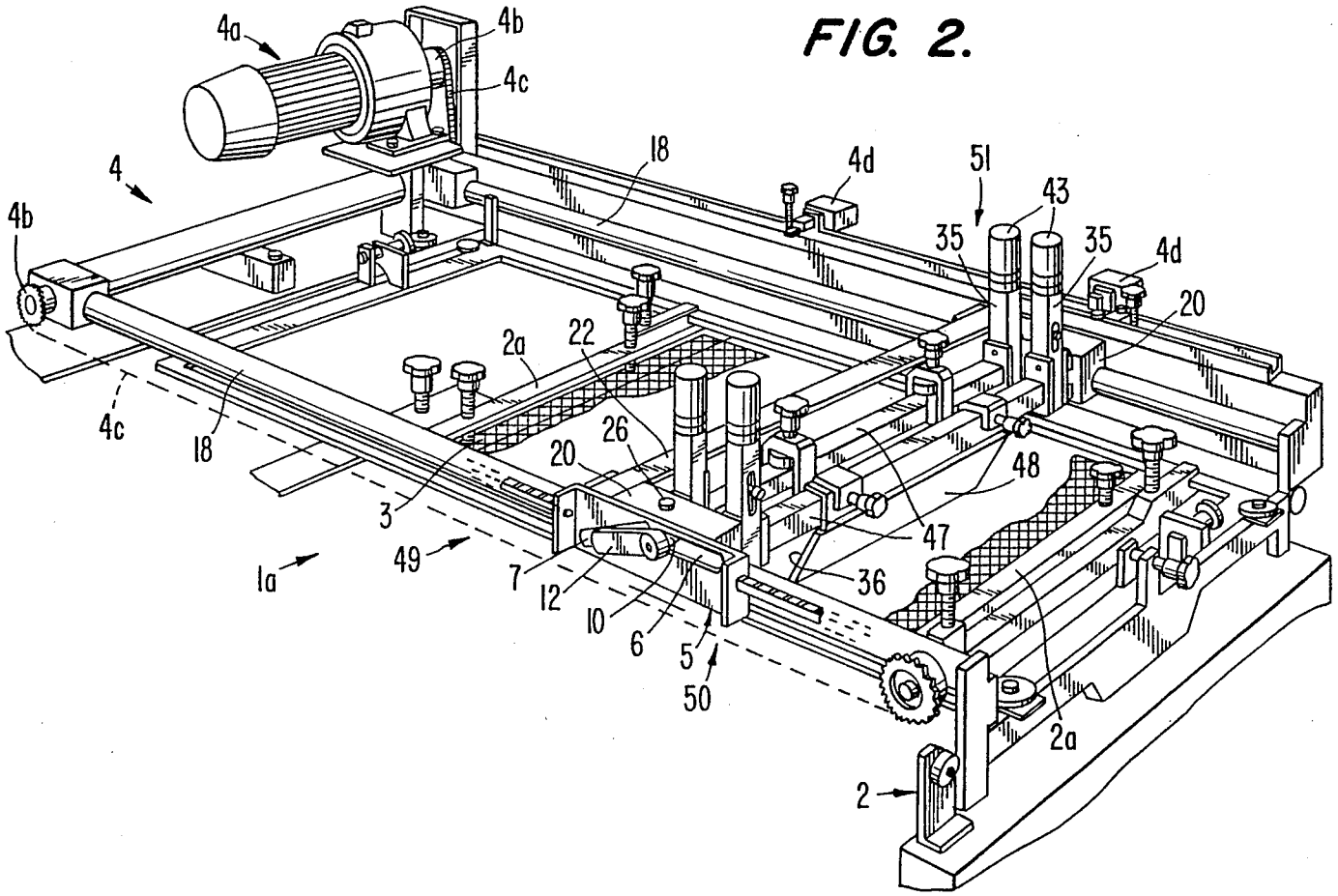
FIG. 2 is a perspective view of a single silk-screen printing station incorporating the drive arrangement of this invention.

A printing station 1*a*, shown generally in FIG. 2, comprises a frame 2 which supports, via position adjustable crossmembers 2*a*, a printing matrix 3 known per se and being depicted partially and schematically.

Mounted on the frame 2 are entrainment members 4 including an electric motor 4*a* arranged to drive a pair of plate elements 5, through various mechanical lay arrangements and specifically a set of sprocket wheels 4*b* and drive chains 4*c*.

The electric motor 4*a* can be driven alternately in opposite directions upon operation of limit switches 4*d* positionable on the frame 2 in parallel with the chains 4*c*.

The plate elements 5 are each formed with a groove which is split into two sections: a first, through section forming a through slot 6, and a second section forming a guide 7 and being defined by a cutout or blind groove in the plate element 5. The latter includes a first stretch 7*a* extending along an inclined direction to the through slot 6 and a second stretch 7*b* extending parallel to the through slot 6.

The plate elements 5 are connected to the chains 4*c* by nuts 8.

A pin 10, which is connected rigidly with a first end to a small lever 12, engages slidingly and rotatably in the through-going slot 6 of the groove in each plate element 5, with the interposition of a bush 9.

The lever 12 has an enlarged end 11 rigid with the pin 10 and a drive end 13 provided with a small pin 14 to which a small roller 15 is journalled which is sized to fit into the guide 7.

The pin 10 is connected, at a second end thereof, rigidly to a first oscillable arm 16. A pair of bars 18 secured to the frame 2 support slidingly a pair of blocks 20 with the interposition of specially provided bushes.

Each block 20 is bored to accommodate the pin 10. The blocks 20 are interconnected by a rod 22 which is fastened by means of screws in recessed seats 24.

A threaded hole is drilled in each block 20 in which a friction assembly fits comprising an adjustment set screw 26, a spring **26*a* compressed by the screw 26, and a small friction block 28 acting on the bar 18 under the bias force of the spring 26*a***.

Fastened to the blocks 20 as by means of screws are brackets or slide plates 30 carrying the plate elements 5 slidingly via bracket-shaped bottom portions **30*a***.

Each block 20 accommodates a second oscillable arm 31 with the intermediary of a lug 32. Each of the oscillable arms 16 and 31 has a pair of minicylinders 33 so as to form, in cooperation with small plates 34, an articulated quadrilateral wherein the minicylinders 33 constitute the articulations. The small plates 34 are therefore four in number, two for each arm 16, 31 pair, and each small plate 34 is connected to a hollow body 35. Each opposing pair of the hollow bodies 35 corresponds to a knife in a knife 36,37 pair. The latter act on the printing matrix 3 to spread and thrust ink or a like liquid, and have main directions of lay which are parallel to each other and to the printing matrix 3.

The hollow bodies 35 extend in the height direction and may themselves operate the limit switches **4*d***.

Inside each hollow body 35 there slides an elongate element 38 terminated with a threaded end 39, an inside threaded adapter bush 40 coupled with the threaded end 39 and held in a socket 41 welded to the hollow body 35, by a circlip 42. An outside knurled small cylinder or operating knob 43 is connected to the adapter bush 40 by a dowel 44.

The hollow body 35 has a slot 45 formed laterally therein which is engaged by a screw 46 adapted to be threaded into the elongate element 38. Each opposing pair of elongate elements 38 is connected by means of screws to a small bar 47 to which the sectional members 48 supporting the knives 36 and 37 are clamped by means of clamps 49.

It is observed in practice that the elements listed hereinabove both embody first members 52 of controlling the reciprocating movement of the knives 36 and 37 in perpendicular and parallel directions to the main directions of lay of the knives and the printing matrix 3, respectively, and second members 50 for controlling the up and down movements of the knives 36, 37 relatively to the printing matrix 3, and mechanical devices 51 for adjusting the knife elevations, again relatively to the printing matrix 3.

The first members 52 for controlling the reciprocating movement of the knives 36 and 37 are embodied by elements denoted by the numerals 4 to 10, 18, 20, and 30.

The second members 50 for controlling the up and down movements of the knives are mainly comprised of simple linkage elements, and advantageously, some important elements, designated 5 and 10, are common to the first and second members to result in mechanical interlinking and operational interdependence. The second drive control members 50 are practically embodied by the elements designated 5,7,10 to 16, and 31 to 34.

The mechanical devices 51 for adjusting the knife positions are embodied by the elements designated 35, and 38 to 46.

This drive arrangement operates as follows.

On each side frame of the frame 2, the chain **4*c* entrains a plate element 5 therealong, which slides over the slide plate 30. Starting from the position shown in FIG. 4, the roller 15 is at the farthest end of the guide 7 from the through slot 6. In this position, the knife 37 is lowered which is aligned to the downward pointing arrow in FIG. 4 and is active in the direction of the arrow shown at the chain 4*c***.

The pin 10, which abuts on one end of the through slot 6, is driven of translatory motion by the plate element 5, and accordingly, will drive in turn the block 20 and knives 36,37 to complete a first working stroke.

Figure 5:
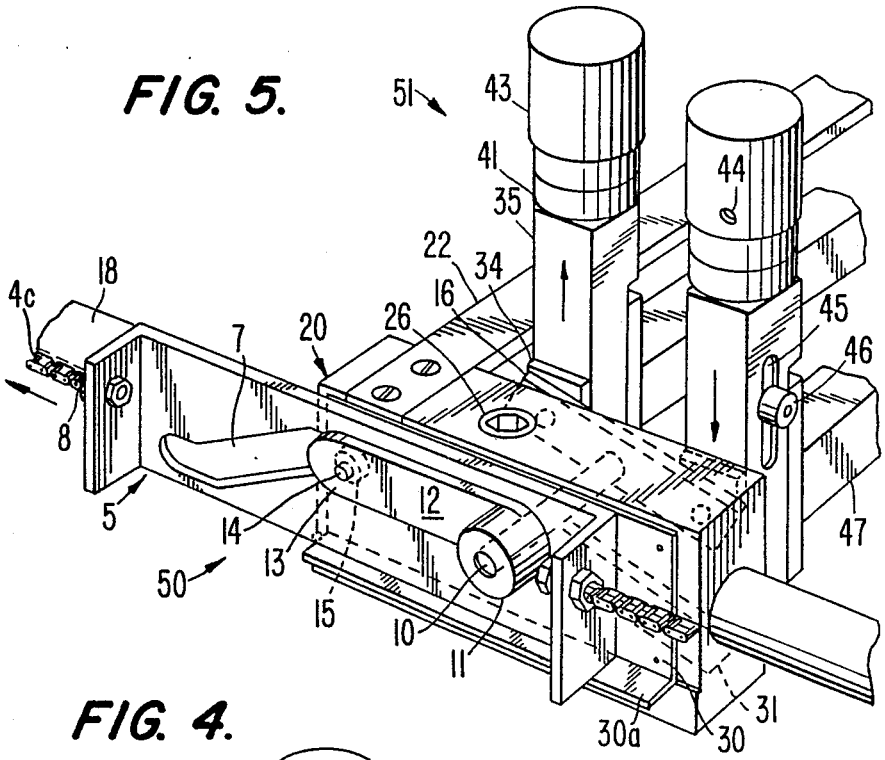
FIGS. 4 and 5 are perspective detail views of the drive arrangement, shown in two different positions thereof which correspond to an active phase of either of the two ink spreading and thrusting knives.

At the end of the first working stroke, as determined by a hollow body 35 interfering with a limit switch **4*d*, for example, the electric motor 4*a* will reverse its direction of rotation, thereby the chain 4*c* reverses its motion and is driven to entrain the plate element 5 in the direction shown in FIG. 5**.

Over a first section corresponding to the distance between the two ledges or ends of the through slot 6, the block 20 will remain stationary owing to the friction from the friction block 28 acting on the bar 18. The roller 15 will instead move upwards along the partly inclined guide 5, and rotate the pin 10 as far as the position shown in FIG. 5, raising vertically upwards, via the oscillable arms 16 and 31, the previously active knife 37 and lowering the other knife 36, which becomes active in its turn.

On the pin 10 reaching its travel limit, the plate element 5, by carrying on its translatory movement, will entrain the block 20 overcoming the friction provided by the friction block 28.

Figure 4:
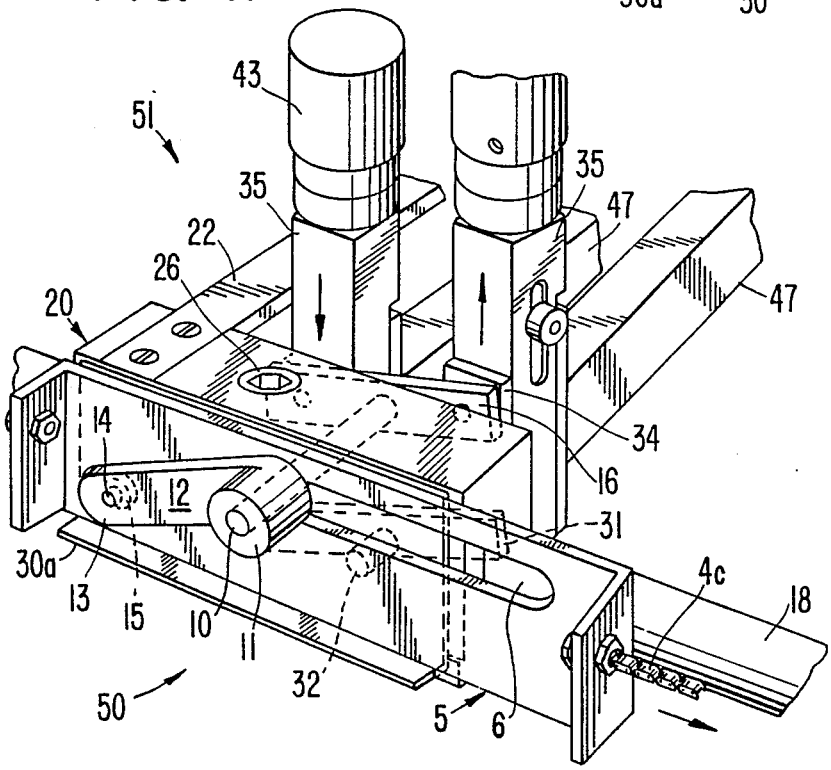
Figure 2:
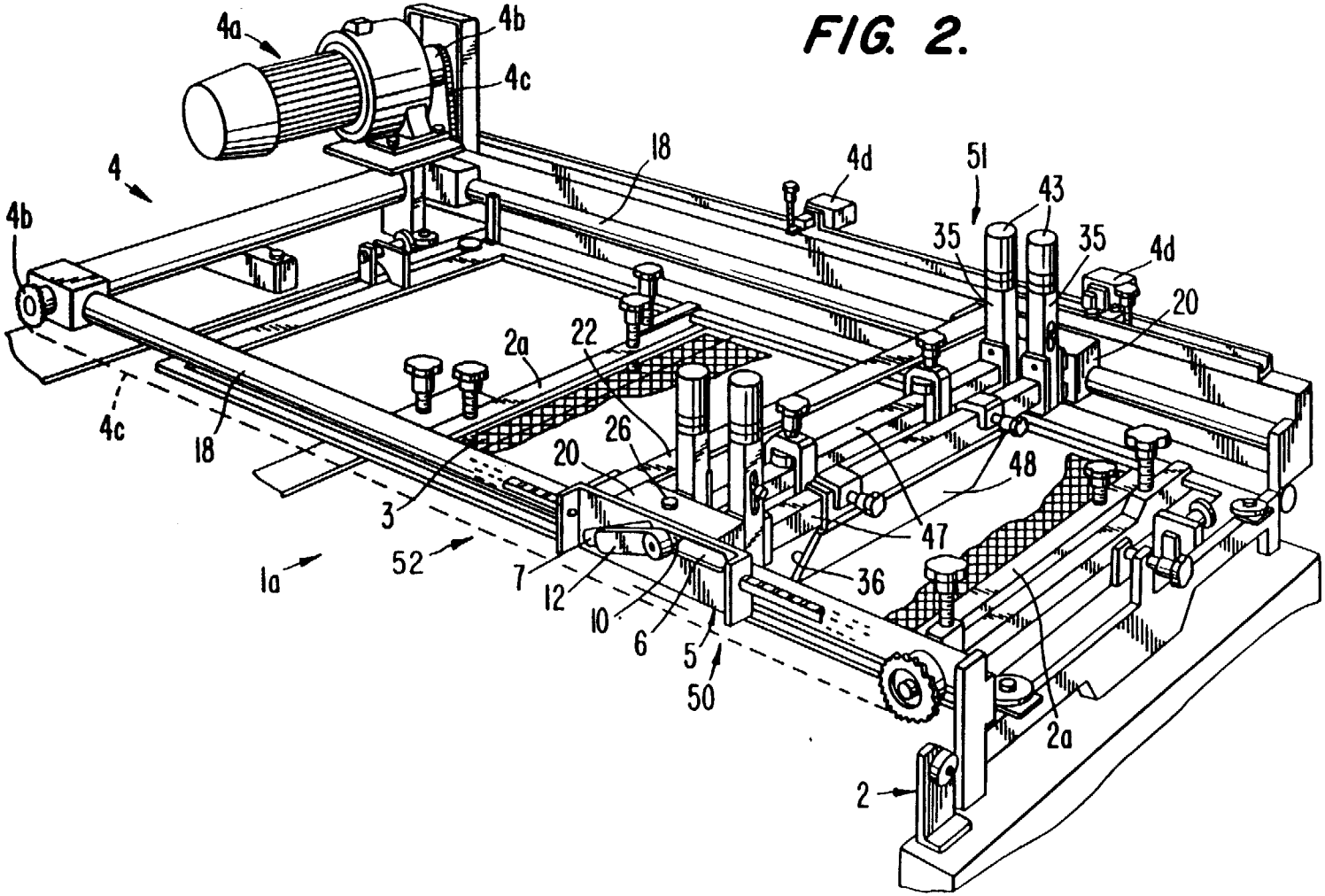
Figure 3:
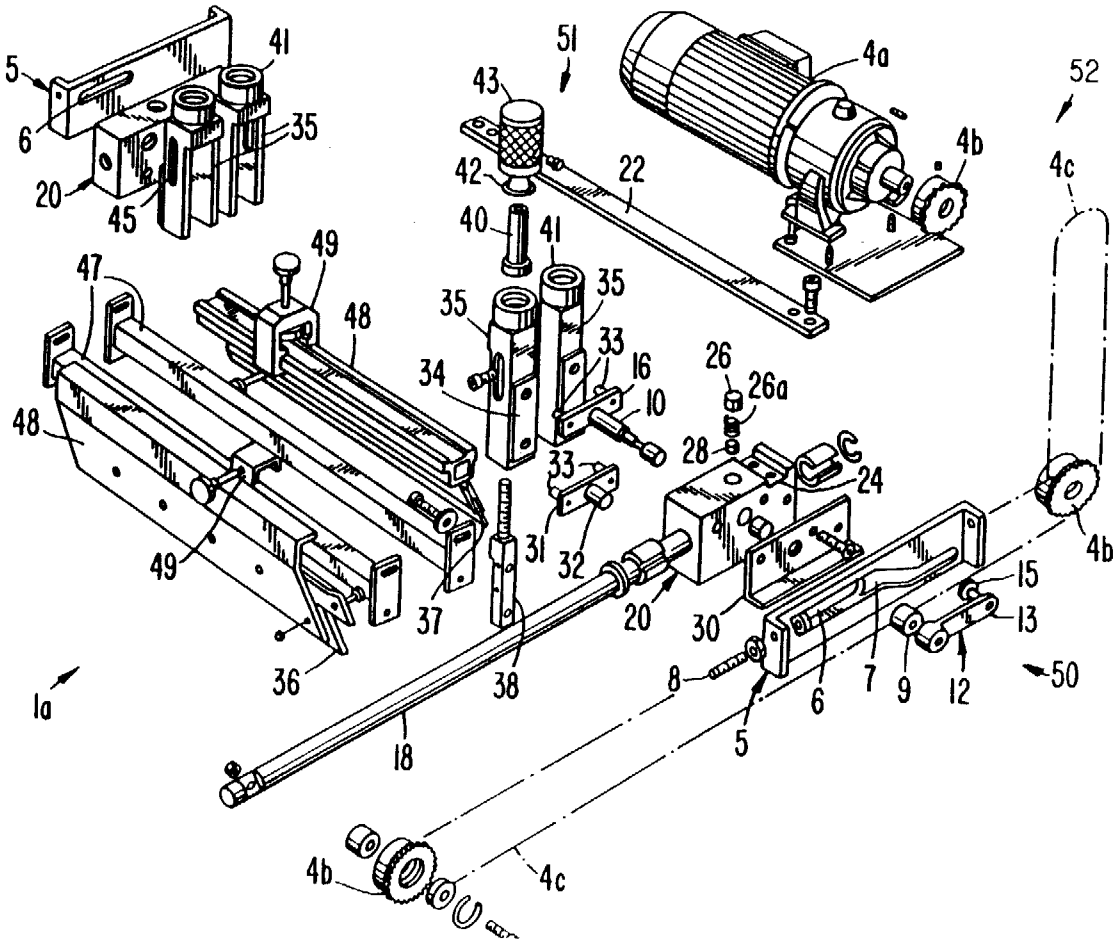
Figure 5:
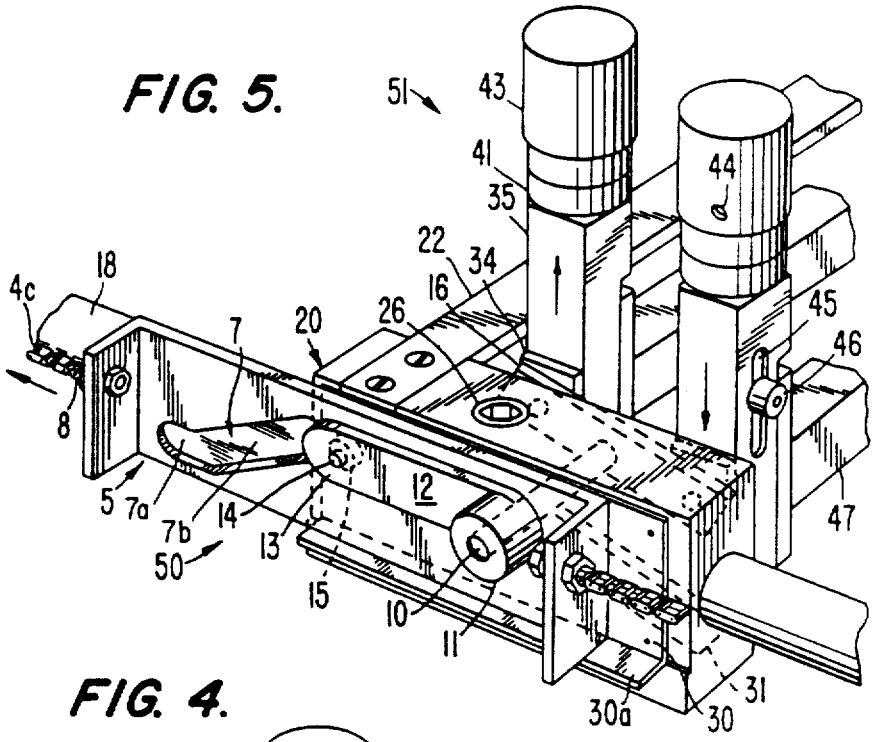
Figure 4:
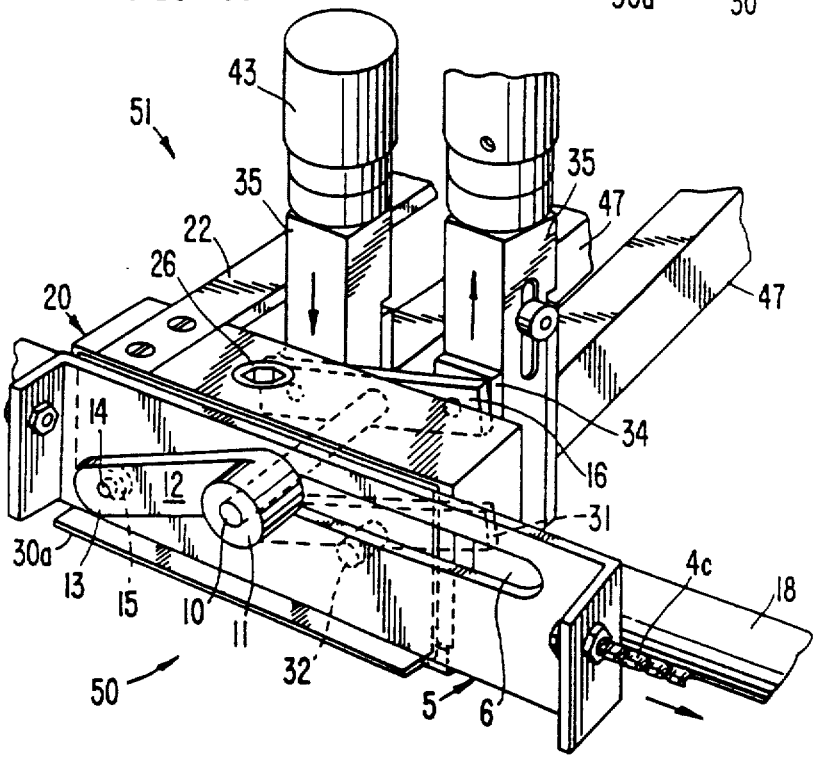

At the end of the active stroke of the knife 37, aligned to the downward pointing arrow in FIG. 5, the translatory movement of the plate element 5 is again reversed to resume the position shown in FIG. 4. At this time, the roller 15 moves downwards along the guide 7 and causes, therefore, the pin 10 to rotate to the position shown in FIG. 4.

In practice, at the end of each working stroke there occurs a raising of that knife which had been lowered, and was therefore active to spread the ink across the matrix 3, for example, and a concurrent lowering of the other knife, which had been raised and presently becomes active, therefore, to thrust the ink through the matrix, for example.

The knives are adjusted in elevation by turning manually each of the small cylinders 43 which will, in turn, rotate the adapter bushes 40. The bushes 40, being retained axially by the circlips 42, will cause the threaded end 39 and hence the elongate elements 38 in turn connected to the knife holding structures to perform translatory movements. On reaching the position selected, the elongate elements 38 will be locked in the hollow bodies 35 by means of the screws 46.

The invention affords some important advantages.

In fact, it may be seen that this arrangement provides for a selective up/down reciprocating ovement of the knives operatively interlinked to the translatory working movement of the blades, using simple and strong mechanical members and without intervening parts driven by compressed air.

Further, the movement of the knives to their stroke limits takes place in an accurate manner and in a strictly vertical direction. Thus, it becomes possible to keep the knives at a constant working angle regardless of the knife elevations over the matrix, which affords evident advantages in relation to their ink spreading and thrusting functions.

Also the height adjustment of the knives is easily carried out to provide accurate positioning of the same at the most appropriate working elevation.

I claim:

1. Drive arrangement for knives employed to spread and thrust ink through printing matrices on silk-screen printing machines, comprising:

first drive members adapted to control reciprocating movements of said knives relative to a matrix, including at least one plate element moving with reciprocating movements parallel to said matrix;

a through slot formed in said plate element and substantially parallel to said matrix; and a pin passed slidingly and rotatably through said through slot and engaging said knives; and second drive members adapted to control up and down movements of said knives relative to said matrix, including a blind cutout formed in said plate element and defining a guide extending in a transverse plane to said pin; and a small lever adjacent to said plate element and having a first end attached transversely to said pin, and a second drive end engaged slidingly with said blind cutout;

said blind cutout defining said guide having a first stretch extending along an inclined direction to said through slot and a second stretch extending parallel to said through slot; and said first stretch being in succession to said through slot and said guide forming with said through slot a substantially single continuous groove in said plate element for controlling both reciprocating and up and down movements of said knives relative to said matrix.

2. Drive according to claim 1, further comprising a block which is penetrated rotatably by said pin and movable with the pin itself, said block being slidable on a fixed slide bar substantially perpendicular to said pin and parallel to said printing matrix.

3. Drive according to claim 2, further comprising at least one slidable plate on one side rigid with said block and on the opposing side carrying slidingly said plate element, said slide plate having a bracket-shaped bottom portion for said plate element to rest thereon.

4. Drive according to claim 2, further comprising, in said block, a threaded hole receiving a friction assembly active on said slide bar, said friction assembly comprising at least one adjusting set screw threaded into said threaded hole, a small block of a material with a high frictional coefficient in contact with said slide bar, and a spring intervening between said small block and said set screw.

5. Drive according to claim 1, wherein an articulated quadrilateral is provided in engagement with adjacent ends of said knives and comprising first and second oscillatable arms substantially parallel to each other and engaged pivotally with said knives, said first oscillable arm being rigid centrally with said pin and a block pivotally penetrated by said pin engaged centrally and rotatably with said second oscillatable arm.

6. Drive according to claim 1, further comprising, between said pin and each of said knives, an elongate element engaged with one of said knives, and wrapped slidingly around said elongate element, a threaded adapter bush engaged rotatably with said threaded end and supported against translation by said hollow element, and a knob for turning said threaded adapter bush, itself and operable by hand.

* * * * *

UNITED STATES PATENT AND TRADEMARK OFFICE

CERTIFICATE OF CORRECTION

PATENT NO. : 4,903, 594

DATED : February 27, 1990

INVENTOR(S) : Pellegrina Ercole

It is certified that error appears in the above-identified patent and that said Letters Patent is hereby corrected as shown below:

The title page, showing the illustrative figure, should be deleted to be replaced with the attached title page.

Substitute new Figure 2 in which reference "49" is changed to "52"

Figure 3:
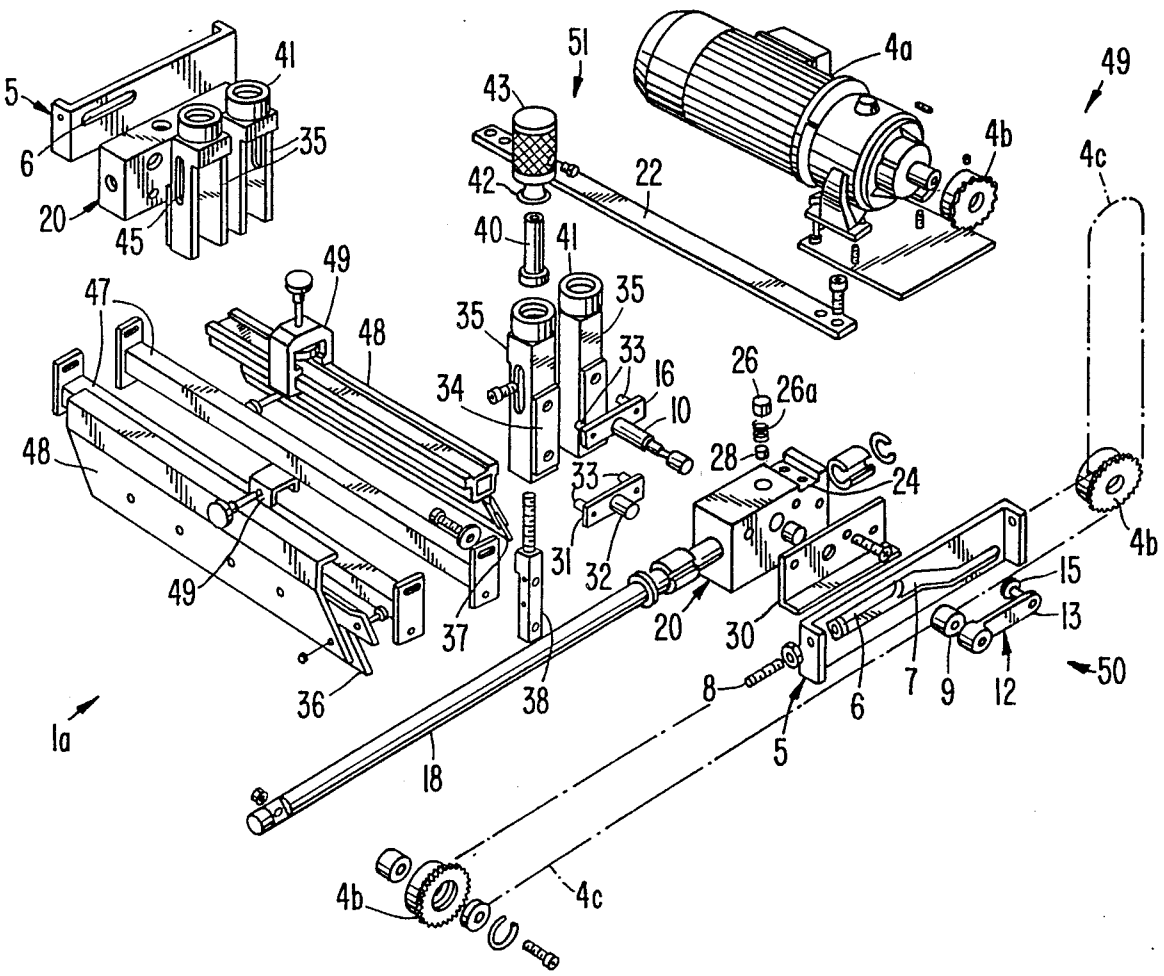
FIG. 3 is an exploded view of this drive arrangement.

Substitute new Figure 3 in which reference "49" is changed to "52"

Substitute new Figure 5 with the insertion of references "7a" and "7b"

Signed and Sealed this

Fourth Day of February, 1992

*Attest:*

*Attesting Officer*

HARRY F. MANBECK, JR.

*Commissioner of Patents and Trademarks*

United States Patent [19]

Ercole

[11] Patent Number: 4,903,594

[45] Date of Patent: Feb. 27, 1990

[54] DRIVE ARRANGEMENT FOR KNIVES IN SILK-SCREEN PRINTING MACHINES

[75] Inventor: Pellegrina Ercole, Rozzano, Italy

[73] Assignee: C.M.S. S.r.l., Zibido San Giacomo, Italy

[21] Appl. No.: 165,088

[22] Filed: Mar. 7, 1988

[30] Foreign Application Priority Data

May 27, 1987 [IT] Italy ..... 21691/87[U]

[51] Int. Cl.[4] ..... B41F 15/42

[52] U.S. Cl. ..... 101/123

[58] Field of Search ..... 101/123, 124

[56] References Cited

U.S. PATENT DOCUMENTS

| | | | |
|---|---|---|---|
| 3,143,961 | 8/1964 | Jaffa et al. | 101/123 |
| 3,731,623 | 5/1973 | Bubley et al. | 101/123 X |
| 3,859,917 | 1/1975 | Bubley et al. | 101/123 |
| 3,885,493 | 5/1975 | Jaffa | 101/123 |
| 4,080,893 | 3/1978 | Wedell | 101/123 X |
| 4,111,118 | 9/1978 | Green et al. | 101/123 |
| 4,276,826 | 7/1981 | Bubley et al. | 101/123 |
| 4,586,433 | 5/1986 | Jaffa et al. | 101/123 |

FOREIGN PATENT DOCUMENTS 3220489 12/1983 Fed. Rep. of Germany ..... 101/123

*Primary Examiner*—Clifford D. Crowder
*Attorney, Agent, or Firm*—Browdy & Neimark

[57] ABSTRACT

A knife drive for spreading and thrusting ink through printing matrices of silk-screen printing machines includes first drive members adapted to impart on knives parallel reciprocating movements to a related matrix and comprising at least one plate element reciprocable parallel to the matrix itself, a through-going slot formed in the plate element and parallel to the matrix, and a pin through-penetrating slidingly and rotatably the through-going slot and engaging the knives, and second drive members adapted to impart on the knives up and down movements with respect to the matrix and comprising a guide rigid with the plate element, extending in a transverse plane to the pin and along a transverse direction to the through-going slot, and a small lever attached transversely to the pin and engaging slidingly with the guide.

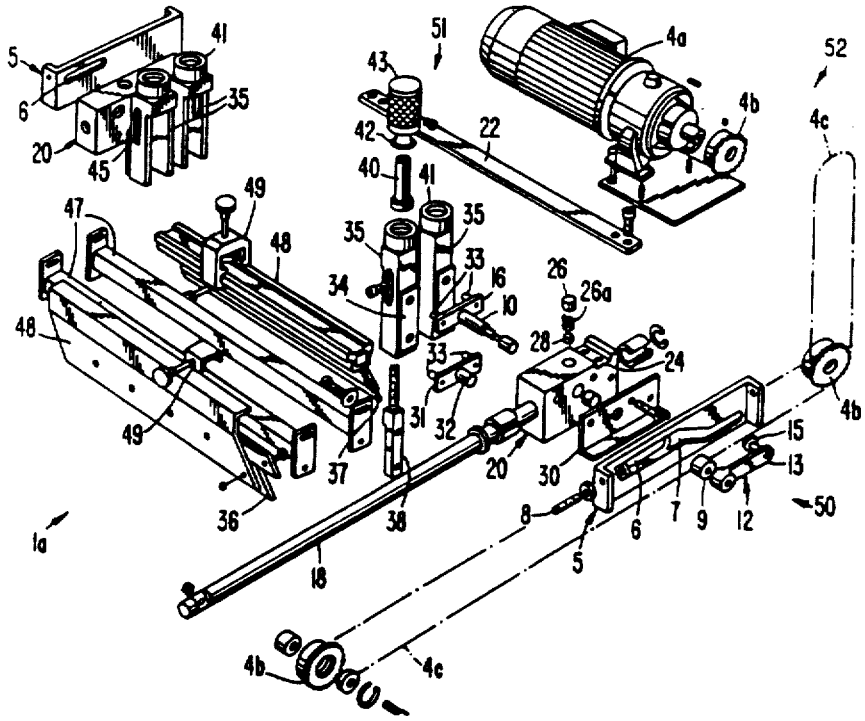

6 Claims, 4 Drawing Sheets